US010518547B2

(12) United States Patent
Sakai et al.

(10) Patent No.: US 10,518,547 B2
(45) Date of Patent: Dec. 31, 2019

(54) LIQUID DISCHARGER AND LIQUID STIRRING METHOD

(71) Applicant: RICOH COMPANY, LTD., Tokyo (JP)

(72) Inventors: Keitaroh Sakai, Kanagawa (JP); Nobuyuki Akaishi, Kanagawa (JP); Shigeru Morinaga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/584,094

(22) Filed: May 2, 2017

(65) Prior Publication Data

US 2017/0341407 A1 Nov. 30, 2017

(30) Foreign Application Priority Data

May 30, 2016 (JP) ..... 2016-107270
Jan. 19, 2017 (JP) ..... 2017-007410

(51) Int. Cl.
*B41J 2/175* (2006.01)
*B41F 31/03* (2006.01)
*B41J 2/21* (2006.01)

(52) U.S. Cl.
CPC ..... *B41J 2/17596* (2013.01); *B41F 31/03* (2013.01); *B41J 2/175* (2013.01); *B41J 2/17509* (2013.01); *B41J 2/2146* (2013.01); *B01F 2215/0059* (2013.01)

(58) Field of Classification Search
CPC ..... B41J 2/19
See application file for complete search history.

(56) References Cited

U.S. PATENT DOCUMENTS 3,332,435 A * 7/1967 Anderson ..... G03D 3/06 137/216
5,591,460 A * 1/1997 Wanstrath ..... B29C 73/025 264/36.21
7,467,858 B2 * 12/2008 Lebron ..... B41J 2/165 347/85
2007/0206048 A1 9/2007 Kusunoki et al.
2008/0291240 A1 11/2008 Ohsako et al.
2009/0002467 A1 * 1/2009 Watanabe ..... B41J 2/16526 347/89

(Continued)

FOREIGN PATENT DOCUMENTS

JP 2010-105390 5/2010
JP 2016-020089 2/2016
WO WO-2013109200 A1 * 7/2013 ..... B01D 53/0446

*Primary Examiner* — Shelby L Fidler
(74) *Attorney, Agent, or Firm* — Oblon, McClelland, Maier & Neustadt, L.L.P.

(57) ABSTRACT

A liquid discharger includes a head including nozzles to discharge liquid from the nozzles, a detachable first container attached to the liquid discharger to accommodate the liquid, a second container connected to the head to accommodate the liquid to be supplied to the head, a supply channel to connect the first container and the second container, an irreversible pump connected to the second container, and a controller to control the irreversible pump to pressurize and decompress the second container to reciprocally move the liquid between the first detachable container and the second container via the supply channel.

17 Claims, 12 Drawing Sheets

(56) References Cited

U.S. PATENT DOCUMENTS

| | | | | |
|---|---|---|---|---|
| 2009/0262150 | A1* | 10/2009 | Morita | B41J 2/175 347/6 |
| 2011/0050816 | A1 | 3/2011 | Katoh et al. | |
| 2011/0063391 | A1 | 3/2011 | Miyamoto et al. | |
| 2011/0229242 | A1 | 9/2011 | Morinaga et al. | |
| 2014/0313271 | A1 | 10/2014 | Morinaga | |
| 2015/0009252 | A1 | 1/2015 | Andoh et al. | |
| 2015/0085033 | A1* | 3/2015 | Ando | B41J 2/19 347/92 |
| 2015/0224802 | A1 | 8/2015 | Kawamichi et al. | |
| 2015/0360190 | A1 | 12/2015 | Sakai et al. | |
| 2017/0100936 | A1 | 4/2017 | Sakai et al. | |

* cited by examiner

LIQUID DISCHARGER AND LIQUID STIRRING METHOD

CROSS-REFERENCE TO RELATED APPLICATIONS

This patent application is based on and claims priority pursuant to 35 U.S.C. § 119(a) to Japanese Patent Application No. 2017-007410, filed on Jan. 19, 2017, and Japanese Patent Application No. 2016-107270, filed on May 30, 2016, in the Japan Patent Office, the entire disclosures of which are hereby incorporated by reference herein.

BACKGROUND

Technical Field

Aspects of the present disclosure relate to a liquid discharger and a liquid stirring method.

Related Art

As to the ink to be used for an industrial inkjet recording apparatus, pigment ink is known, which employs pigment that is not easily dissolved in a solvent. The pigment included in the pigment ink tends to precipitate out and be deposited as sedimentation, and when the ink with a non-uniform density is supplied to the recording head, the denser portion clogs the nozzles of the apparatus, damaging image quality. Thus, the pigment ink is stirred by moving the pigment ink between the ink cartridge and a second container, to give the ink a more uniform consistency.

SUMMARY

In at least one embodiment of the present disclosure, there is provided an improved liquid discharger for discharging a liquid. The liquid discharger includes a head including nozzles to discharge liquid from the nozzles, a detachable first container attached to the liquid discharger to accommodate the liquid, a second container connected to the head to accommodate the liquid to be supplied to the head, a supply channel to connect the first container and the second container, an irreversible pump connected to the second container, and a controller to control the irreversible pump to pressurize and decompress the second container to reciprocally move the liquid between the first detachable container and the second container via the supply channel.

Figure 1:
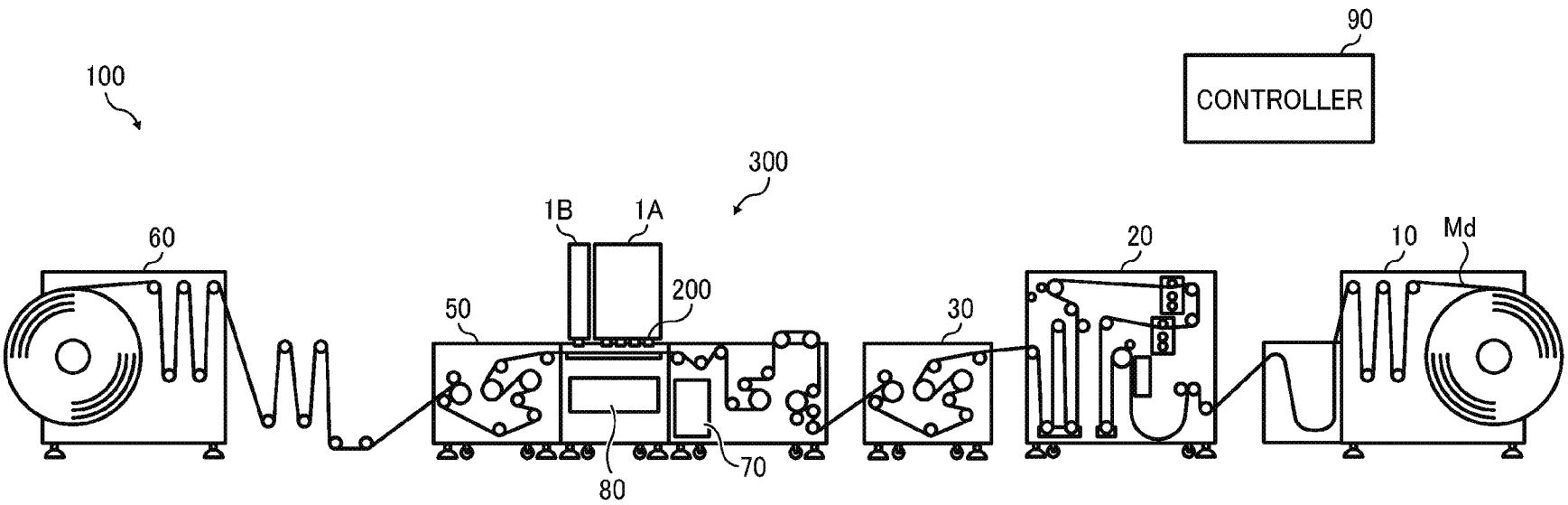
FIG. 1 is a schematic view of a liquid discharger according to the embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural foul's as well, unless the context clearly indicates otherwise.

Referring now to the drawings, wherein like reference numerals designate identical or corresponding parts throughout the several views, embodiments of the present disclosure are described below.

Hereinafter, a liquid discharge apparatus according to embodiments of the present disclosure will be described referring to accompanying drawings.

FIG. 1 schematically illustrates an image forming apparatus 100 according to an embodiment of the present disclosure. The image forming apparatus 100 includes a liquid discharger 300 to discharge droplets to form an image on a recording medium Md. As illustrated in FIG. 1, the image fainting apparatus 100 includes a conveyer 10, a pretreatment unit 20, a dryer 30, the liquid discharger 300, a post-treatment unit 50, a discharge conveyer 60, and a controller 90.

A paper roll Md as a recording medium is a rolled-up continuous sheet or form with perforations at regular intervals. The conveyer 10 conveys the paper roll Md to the pretreatment unit 20. The pretreatment unit 20 performs a pretreatment to a surface of the paper roll Md and sends the pretreated paper roll Md to the dryer 30. The dryer 30 dries the surface of the paper roll Md and sends the dried paper roll Md to the liquid discharger 300.

The liquid discharger 300 includes liquid discharge devices 1A and 1B, a liquid supplier device 70, and a head maintenance unit 80. The liquid discharge devices 1A and 1B discharges droplets from head units 200 to form an image on the paper roll Md. The liquid discharge devices 1A and 1B are collectively referred to as a liquid discharge device 1. The head units 200 of the liquid discharge devices 1A and 1B discharge droplets of ink to a surface of the pretreated and dried paper roll Md thereby fainting an image on the surface of the paper roll Md.

The liquid supplier device 70 stirs the ink to equalize the density of the ink and supplies the ink to the liquid discharge devices 1A and 1B. The head maintenance unit 80 maintains the head units 200 of the liquid discharge devices 1A and 1B in good condition.

The paper roll Md output from the liquid discharge device is conveyed to the post-treatment unit 50. The post-treatment unit 50 performs post-treatment to the paper roll Md and sends the paper roll Md to the discharge conveyer 60. The discharge conveyer 60 rolls up the paper roll Md. The controller 90 controls the conveyer 10, the pretreatment unit 20, the dryer 30, the liquid discharger 300, the post-treatment unit 50, and the discharge conveyer 60 to perform the series of operation described above.

The recording medium according to the present embodiment is not limited to a paper roll. The recording medium according to the present embodiment includes cut paper, a normal sheet, grade paper, thin paper, thick sheet, a recording sheet, an overhead projector (OHP) sheet, synthesized resin film, metallic thin film, and any other material on which an image can be formed with ink, and the like.

Figure 2:
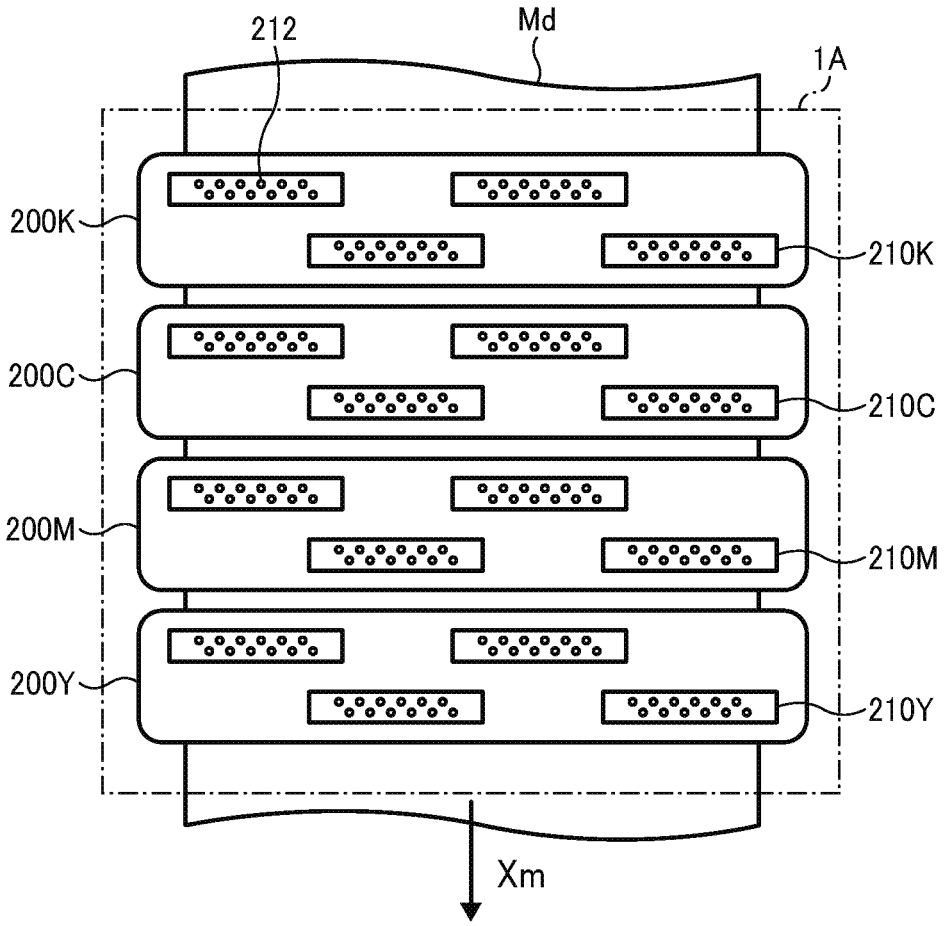
FIG. 2 is a schematic plan view of a head unit according to the embodiment of the present disclosure.

FIG. 2 is a schematic plan view of the liquid discharge devices 1A according to the present embodiment. As illustrated in FIG. 2, the liquid discharge devices 1A according to the present embodiment employs a full-line type recording head. For example, the head unit 200K of the liquid discharge devices 1A includes four heads 210K arranged in staggered manner along a direction perpendicular to the conveyance direction Xm of the paper roll Md to cover the width of a recoding region of the paper roll Md. The present embodiment may use a bar-like elongated full-line type recording head having a length sufficient to cover the width of the recording medium with one head. The head unit 200 includes four head units 200K, 200C, 200M, and 200Y disposed from upstream in the conveyance direction Xm of the paper roll Md.

Suffixes of K, C, M, and Y on each of the head units 200 respectively represent colors of black, cyan, magenta, and yellow. The order of the colors K, C, M, and Y is not limited to the exemplary order of FIG. 2, but any different order may be possible. In addition, the color of each head unit 200 may be, for example, green, red, light cyan, or other colors. Alternatively, the color may be monochrome such as black only.

Herein, the head unit 200K for the color black (K) includes four black heads 210K disposed in a staggered manner along a direction perpendicular to the conveyance direction Xm of the paper roll Md. With this structure, the head unit 200K can form a black image over an entire printable area of the paper roll Md. Other head units 200C, 200M, and 200Y are configured similarly to the head unit 200K for black (K). For example, the head unit 200C for the color cyan (C) includes four cyan heads 210C, the head unit 200M for the magenta (M) includes four magenta heads 210M, and the head unit 200Y for the color yellow (Y) includes four yellow heads 210Y.

The term "liquid discharge device" means a structure including the head unit 200 and other functional part(s) or mechanisms integrated with or united thereto. That is, "liquid discharge device" is an assembly of parts relating to liquid discharge. In the above-described embodiment of the present disclosure, the liquid discharge device 1 includes a device that drives the head unit 200 to discharge liquid.

Figure 3:
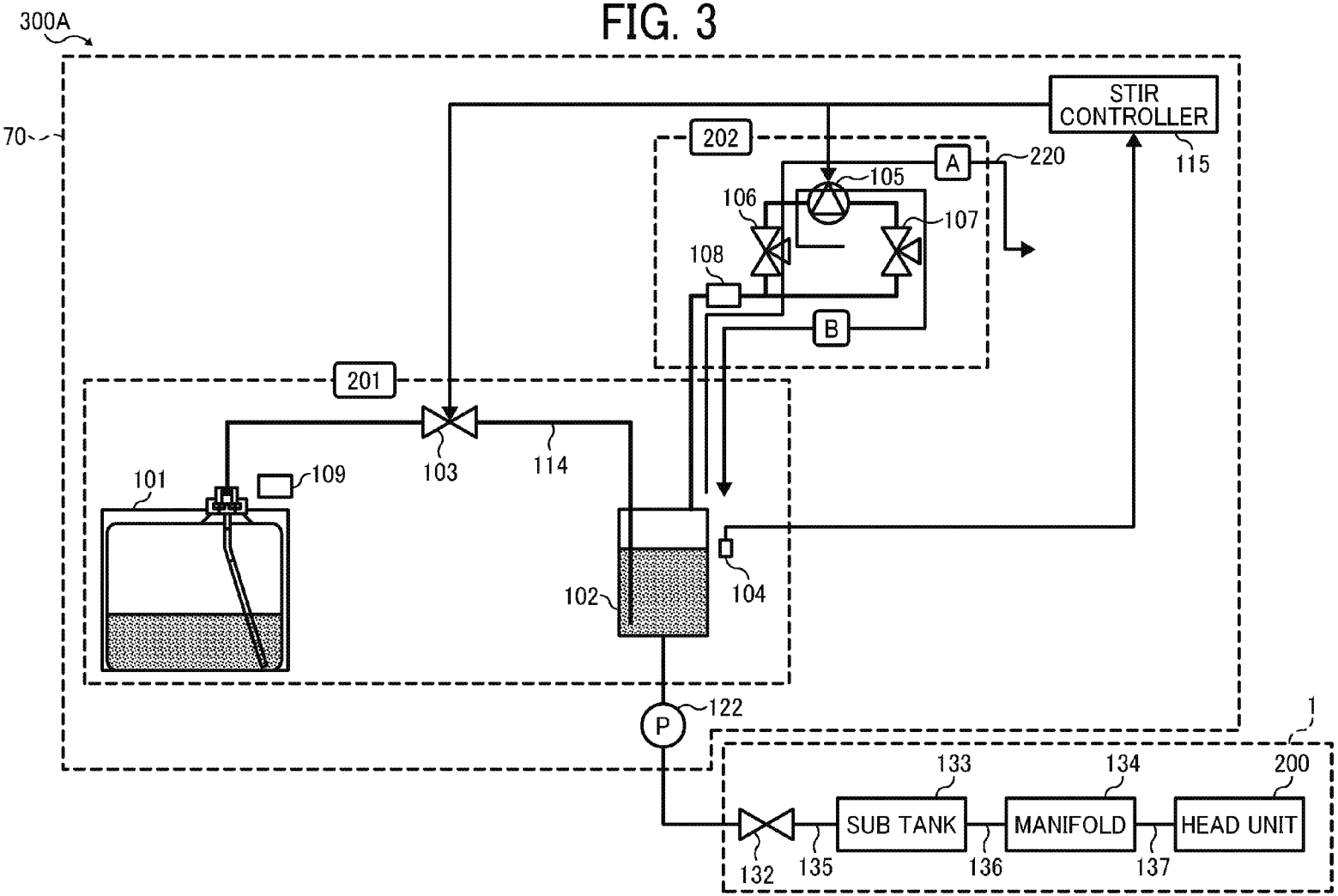
FIG. 3 is a block diagram of a liquid supplier device according to the embodiment of the present disclosure.

FIG. 3 schematically illustrates the liquid discharger 300A according to a first embodiment. The liquid discharger 300A according to the present embodiment stirs liquid (ink) to equalize the density of the liquid in a cartridge 101. The cartridge 101 accommodates the liquid to be supplied to the head unit 200.

As illustrated in FIG. 3, the liquid discharger 300A includes the liquid supplier device 70 and the liquid discharge device 1. The liquid supplier device 70 includes a cartridge 101 as a first container, a second container 102, a supply channel 114, a pressure unit 202, a supply valve 103, and a stir controller 115. The cartridge 101 is detachable and attachable to the liquid discharger 300A. The cartridge 101 accommodates ink to be supplied to the second container 102. The second container 102 accommodates ink to be supplied to the head unit 200 of the liquid discharge device 1. The second container 102 has a smaller capacity than a capacity of the cartridge (first container) 101.

The supply channel 114 connects the cartridge 101 with the second container 102. The supply valve opens and closes the supply channel 114. A supply unit 201 includes the cartridge 101, the second container 102, and the supply valve 103. The second container 102 includes a detector 104 to detect a liquid amount inside the second container 102.

The pressure unit 202 includes a vacuum pump 105, a first three-way valve 106, a second three-way valve 107, a pressure detector 108, and a fluid channel to connect the vacuum pump 105. The pressure unit 202 is connected to and communicates with the second container 102. The vacuum pump 105 of the pressure unit 202 is an irreversible pump. The first three-way valve 106 and the second three-way valve 107 are independently operated to control the flow of the liquid moved by the vacuum pump 105.

The pressure detector 108 detects the pressure inside the second container 102. The stir controller 115 controls the vacuum pump 105, the first three-way valve 106, the second three-way valve 107, and the supply valve 103 to pressurize or decompress the second container 102 to reciprocally move the liquid (ink) between the cartridge 101 (the first container) and the second container 102 via the supply channel 114.

Figure 5A:
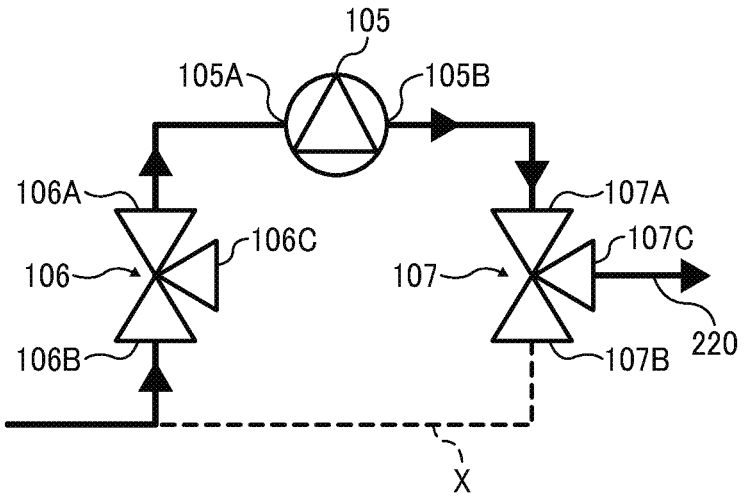
FIGS. 5A and 5B are enlarged schematic diagrams of the pressure unit, illustrating a decompression route A and a pressurizing route B, respectively.
Figure 5B:
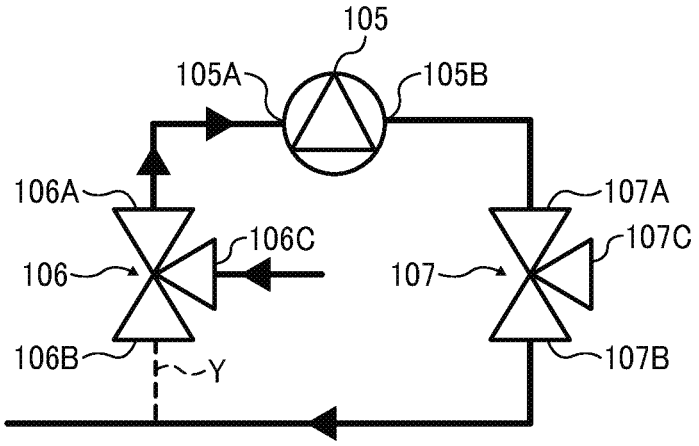

The present embodiment uses the irreversible vacuum pump 105. The vacuum pump 105 has a greater supply capacity than a supply capacity of a reversible pump. Thus, the liquid supplier device 70 of the present embodiment can pressurize and decompress the second container 102 with greater pressure than the liquid discharger using a reversible pump. Therefore, the liquid supplier device 70 reciprocally moves and stirs ink in the supply channel 114 with a higher flow rate than before. The pressure unit 202 forms a decompression route A and a pressurizing route B as illustrated in FIGS. 5A and 5B, which will be described below. The decompression route A is formed for decompressing the second container 102. The pressurizing route B is formed for pressurizing the second container 102.

As the supply channel 114, a flexible tube, or a pipe made of resin or metal may be used. The vacuum pump 105 is a diaphragm pump that cannot perform reversible operation such as changing a flow direction of the ink. However, the vacuum pump 105 can change a flow rate of the ink by changing the drive time of the vacuum pump 105. The vacuum pump 105 has a higher flow rate and durability than a reversible pump.

A detector 104 is a sensor to detect a liquid level of the ink in the second container 102. The detector 104 is disposed at an upper part of the second container 102. The detector 104 is used to detect an upper limit of the ink amount inside the second container 102. The stir controller 115 calculates an ink amount inside the second container 102 from the liquid level detected by the detector 104. A capacitance level sensor, for example, may be used for the detector 104.

The stir controller 115 includes a microcomputer. The stir controller 115 calculates an amount of ink inside the second container 102 using data obtained from the pressure detector 108 and the vacuum pump 105 and controls a drive time and a drive speed of the irreversible vacuum pump 105. Specifically, the stir controller 115 controls the liquid movement between the cartridge 101 and the second container 102 such that the amount of ink moved between the cartridge 101 and the second container 102 does not exceed an upper limit of the capacity of the second container 102. Furthermore, the stir controller 115 controls the liquid movement between the cartridge 101 and the second container 102 such that the second container 102 does not become empty.

The stir controller 115 stores in the memory 109 (*a*) time (date and time of stirring) of reciprocally moving the ink in the supply channel 114 last time and (b) an amount of the ink (number of times of ink movement) reciprocally moved in the supply channel 114 last time. The stir controller 115 calculates elapsed time since the last time the ink was stirred. The stir controller 115 performs the reciprocal movement of the ink after predetermined time has passed since the stored last moving (stirring) time. Thereby, the present embodiment can periodically stir the ink in the cartridge 101 to equalize the density of the ink in the cartridge 101.

The liquid discharge device 1 includes a cutoff valve 132, a sub-tank 133, a manifold 134, a sub-tank channel 135, a manifold channel 136, a head channel 137, and the head unit 200. The sub-tank channel 135 connects the second container 102 with the sub-tank 133. The manifold channel 136 connects the sub-tank 133 with the manifold 134. The head channel 137 connects the manifold 134 with the head unit 200.

The sub-tank 133 stores the ink supplied from the second container 102 and supplies the ink to the manifold 134. The manifold distributes the ink supplied from the sub-tank 133 to the plurality of head units 200.

The cutoff valve 132 is disposed on the sub-tank channel 135. The cutoff valve 132 cuts off the sub-tank channel 135 to protect the sub-tank 133, the manifold 134, and the head unit 200 from the influence of the stirring process performed upstream of the cutoff valve 13 between the cartridge 101 and the second container 102. The second pump 122 is disposed at the sub-tank channel 135. The second pump 122 supplies ink to the head unit 200 via the sub-tank 133 and the manifold 134 from the second container 102.

Figure 4:
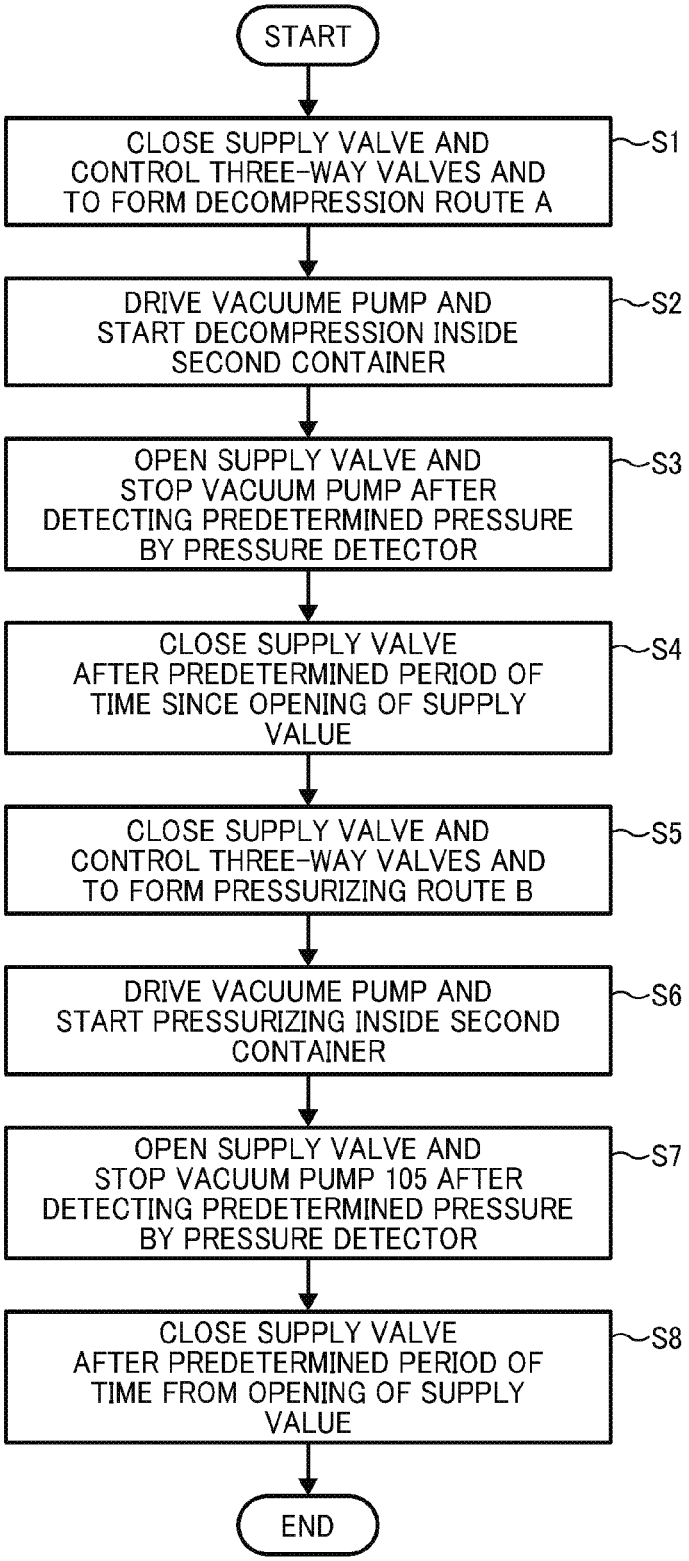
FIG. 4 is a flowchart of steps in a process of controlling of a pressure unit.

FIG. 4 is a flowchart of steps in a process of controlling of a pressure unit 202. The stir controller 115 of the pressure unit 202 controls the vacuum pump 105, the first three-way valve 106, and the second three-way valve 107 to reciprocally move the ink.

First, the stir controller 115 closes the supply valve 103 and forms the decompression route A using the first three-way valve 106 and the second three-way valve 107 (S1). Then, the stir controller 115 drives the vacuum pump 105 and exhausts air from an exhaust port 220 to decompress the second container 102 (S2) as illustrated in FIG. 3. When the stir controller 115 detects a predetermined negative pressure in the pressure unit 202 with the pressure detector 108, the stir controller 115 opens the supply valve 103 and stops driving the vacuum pump 105 (S3). The stir controller 115 can thereby introduce ink from the cartridge 101 to the second container 102 by the negative pressure generated inside the second container 102 with the pressure unit 202. Next, after a predetermine period of time since opening of the supply valve 103, or upon the detector 104 detecting the upper limit of ink amount in the second container 102, the stir controller 115 closes the supply valve 103 (S4).

Next, the stir controller 115 closes the supply valve 103 and forms the pressurizing route B using the first three-way valve 106 and the second three-way valve 107 (S5). Then, the stir controller 115 drives the vacuum pump 105 and pressurizes the second container 102 (S6). When the stir controller 115 detects a predetermined positive pressure in the pressure unit 202 with the pressure detector 108, the stir controller 115 opens the supply valve 103 and stops driving the vacuum pump 105 (S7). The stir controller 115 can thereby transfer the ink in the second container 102 to the cartridge 101. Then, the stir controller 115 closes the supply valve 103 after a predetermined period of time since the opening of the supply valve 103 (S8). Up to here, the ink moves reciprocally once between the cartridge 101 and the second container 102.

FIGS. 5A and 5B are enlarged schematic diagrams of the pressure unit 202. FIG. 5A is an enlarged partial view of the decompression route A. FIG. 5B is an enlarged partial view of the pressurizing route B. In FIGS. 5A and 5B, the first three-way valve 106 includes ports 106A, 106B, and 106C, and the second three-way valve 107 includes ports 107A, 107B, and 107C.

As illustrated in FIG. 5A, the stir controller 115 controls the first three-way valve 106 to open the ports 106A and 106B and close the port 106C. The stir controller 115 further controls the second three-way valve 107 to open the ports 107A and 107C and close the port 107B to form the decompression route A. Then, the stir controller 115 drives the vacuum pump 105 and exhausts air in the pressure unit 202 from an exhaust port 220 as indicated by arrow in FIG. 5A.

At this time, air does not escape from the pressure unit 202 from the port 106C because the stir controller 115 closes the port 106C. Further, air does not escape from the pressure unit 202 from a route X as indicated by broken line in FIG. 5A because the stir controller 115 closes the port 107B. Then, the stir controller 115 exhausts air in the pressure unit 202 through the port 107C to decompress the pressure unit 202 and also the second container 102 connected to the pressure unit 202.

In FIG. 5B, the stir controller 115 controls the first three-way valve 106 to open the ports 106A and 106C and close the port 106B. The stir controller 115 further controls the second three-way valve 107 to open the ports 107A and 107B and close the port 107C to form the pressurizing route B. Then, the stir controller 115 drives the vacuum pump 105 and creates air flow in the pressure unit 202 as indicated by arrow in FIG. 5B. Then, the stir controller 115 supplies air into the second container 102. At this time, air does not escape from the pressure unit 202 from a route Y as indicated by broken line in FIG. 5B because the stir controller 115 closes the port 106B. Further, air does not escape from the pressure unit 202 from the port 107C because the stir controller 115 closes the port 107C. Finally, the stir controller 115 vacuums up air from the port 106C and supplies air to the second container 102 to pressurize the second container 102 connected to the pressure unit 202.

The vacuum pump 105 includes an inflow port 105A and an outflow port 105B. As illustrated in FIG. 3, the vacuum pump 105 communicates with the second container 102 that accommodates the liquid to be supplied to the head unit 200. One of the port 106A of the first three-way valve 106 is connected to the inflow port 105A of the vacuum pump 105.

One of the port 107A of the second three-way valve 107 is connected to the outflow port 105B of the vacuum pump 105. Another port 106B of the first three-way valve 106 and another port 107B of the second three-way valve 107 are connected to the second container 102. Then, the stir controller 115 controls the first three-way valve 106 and the second three-way valve 107 and drives the vacuum pump 105 to pressurize or decompress the second container 102 (S6).

The stir controller 115 calculates a number of movements based on the time elapsed after the last stir date. The reciprocal movement of the ink is performed for a first predetermined number of times, and the stir controller 115 memorizes the stir date and the number of movements. The ink stirring operation is thus completed.

Figure 6:
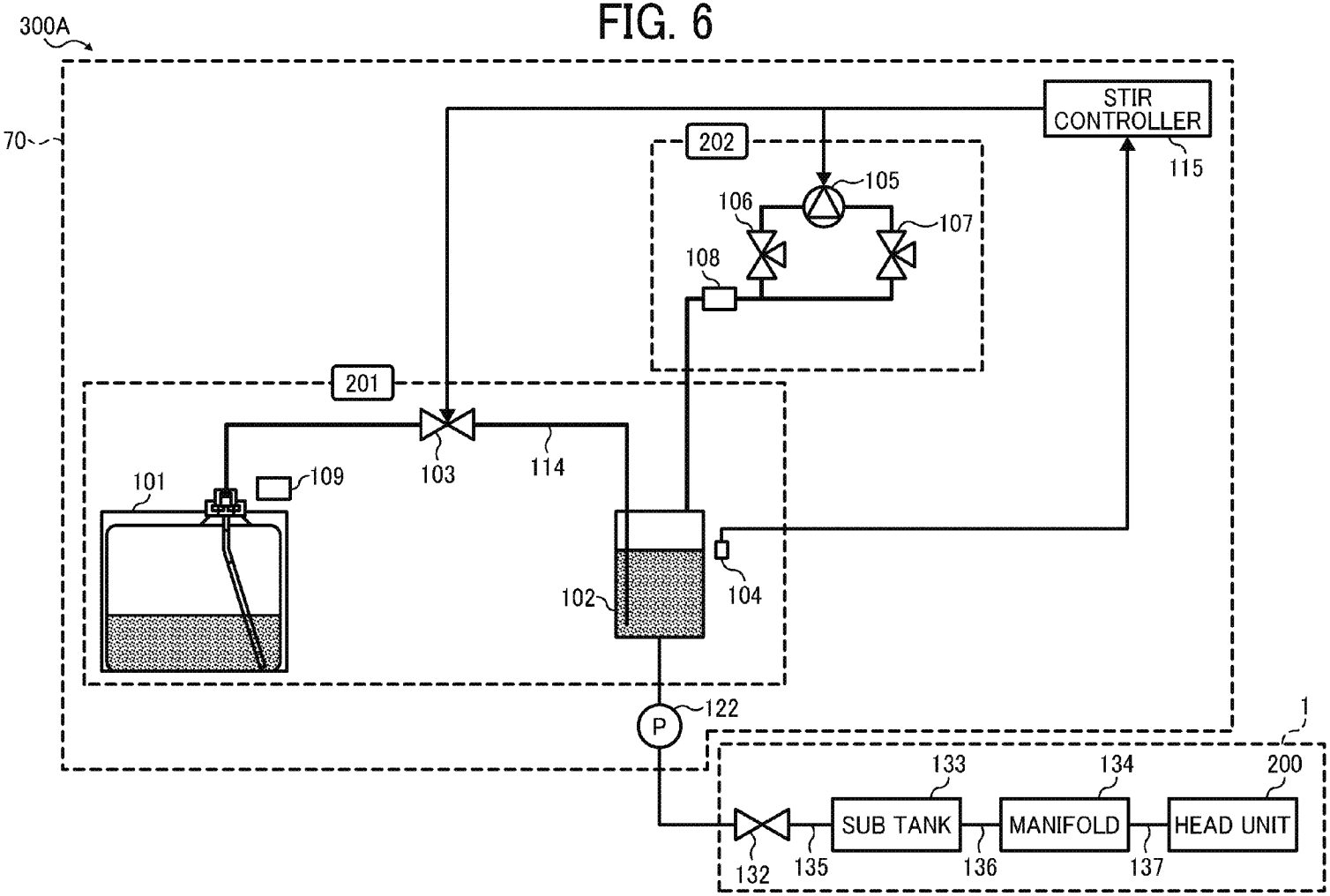
FIG. 6 schematically illustrates the liquid supplier device according to a second embodiment of the present disclosure.

FIG. 6 schematically illustrates the liquid discharger 300A according to a second embodiment. In FIG. 6, parts or components that are similar to those illustrated in FIG. 3 are given the same reference numerals and redundant description thereof omitted.

In the configuration illustrated in FIG. 6, the liquid supplier device 70 of the liquid discharger 300A includes a memory 109. The stir controller 115 stores in the memory 109 information related to (a) type of ink in the cartridge 101, and (b) time of reciprocally moving ink in the supply channel 114 last time (last stir date). The stir controller 115 controls number of times of reciprocal movement of the ink and frequency of ink stirring operation according to the (a) type of ink and the (b) last stir date. According to this configuration, the liquid discharger 300A can perform the appropriate stirring operation according to the type of ink in the cartridge 101.

Even when the user erroneously removes the cartridge 101 from the liquid discharger 300A, or when the apparatus has not been used for a long time since last stir date, the liquid discharger 300A stores the last stir date of the cartridge 101 in the memory 109. Thus, the liquid discharger 300A can perform the appropriate ink stirring process at an appropriate period of time to prevent degradation of quality of the ink occurred by sedimentation of the ink in the cartridge 101.

Figure 7:
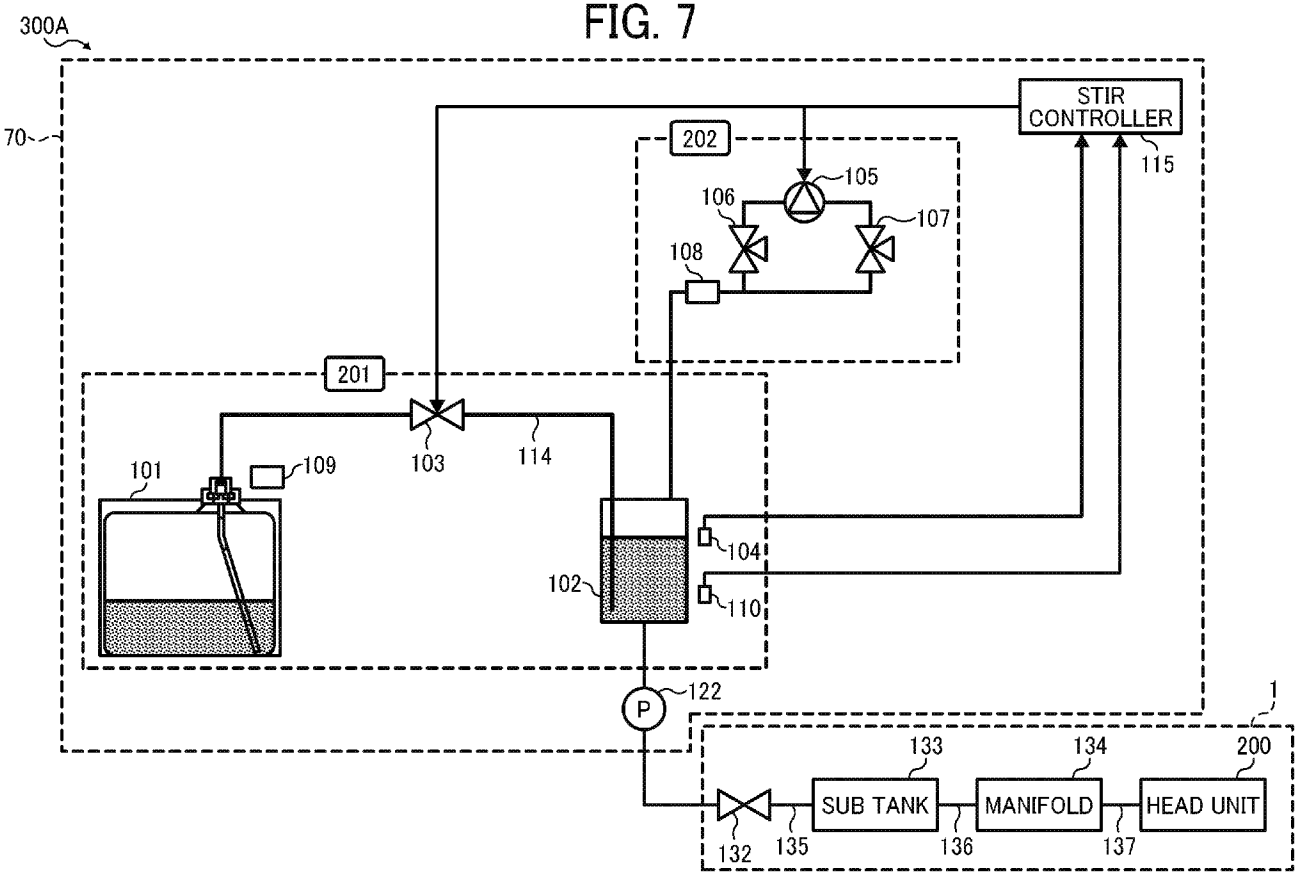
FIG. 7 schematically illustrates the liquid supplier device according to a third embodiment of the present disclosure.

FIG. 7 schematically illustrates the liquid discharger 300A according to a third embodiment. In FIG. 7, parts or components similar to those illustrated in FIG. 3 are given the same reference numerals and redundant description thereof omitted.

As illustrated in FIG. 7, the second container 102 includes a second detector 110 to detect a liquid amount that is smaller than the liquid amount to be detected by the detector 104 and larger than the empty amount. The stir controller 115 controls the liquid amount to be supplied to the supply channel 114 based on a detection signal output from the detector 104 and the second detector 110. Specifically, the liquid discharger 300A moves the ink between the cartridge 101 and the second container 102 at once for an amount corresponds to a difference of two liquid amount (liquid level) detected by the detector 104 and the second detector 110 during the ink stirring operation. The stir controller 115 calculates an amount of ink inside the second container 102 using data obtained from the pressure detector 108 and the vacuum pump 105 and controls a drive amount of the irreversible vacuum pump 105.

Figure 8:
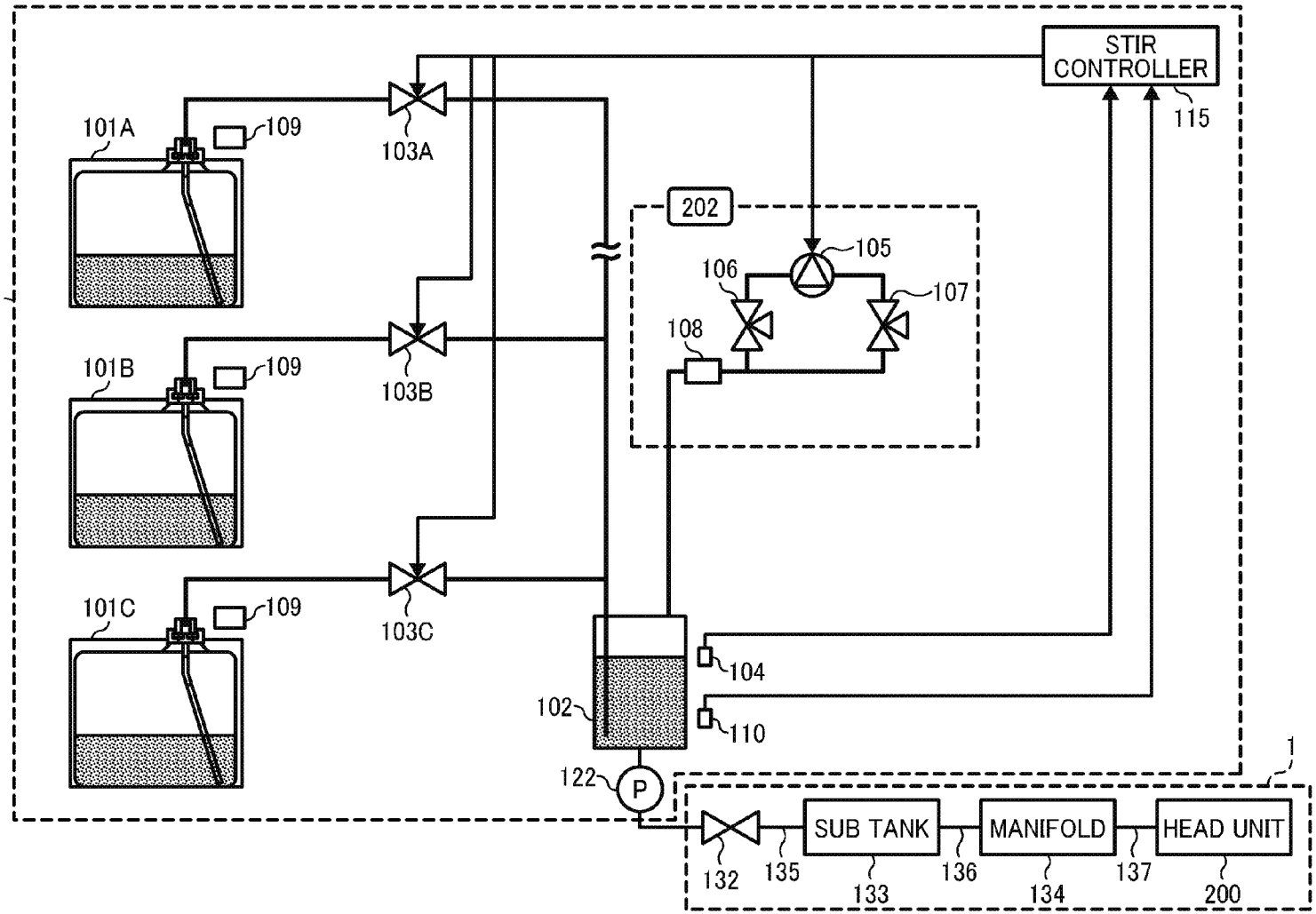
FIG. 8 schematically illustrates the liquid supplier device according to a fourth embodiment of the present disclosure.

FIG. 8 schematically illustrates the liquid discharger 300B according to a fourth embodiment. In FIG. 8, parts or components similar to those illustrated in FIG. 7 are given the same reference numerals and redundant description thereof omitted.

As illustrated in FIG. 8, the liquid discharger 300B includes a plurality of cartridges 101A, 101B, and 101C and a plurality of supply valves 103A, 103B, and 103C, which corresponds to the plurality of cartridges 101A, 101B, and 101C, respectively. The cartridges 101A, 101B, and 101C are detachable to the liquid discharger 300B. According to this configuration, the liquid discharger 300B can use the cartridge 101B or 101C when one cartridge 101A becomes empty. In this way, the liquid discharger 300B can reduce downtime caused by detaching the cartridge 101 because the liquid discharger 300B can discharge ink from the head unit 200 while switching the cartridge 101 to be used.

The liquid discharger 300B may move the ink among the plurality of cartridges 101A, 101B, and 101C via the second container 102. For example, the liquid discharger 300B can supply the ink in the cartridge 101B to the cartridge 101A via the second container 102 when the cartridge 101A becomes empty. The liquid discharger 300B of the present embodiment can thereby perform stronger stirring process than the conventional apparatus.

Figure 9A:
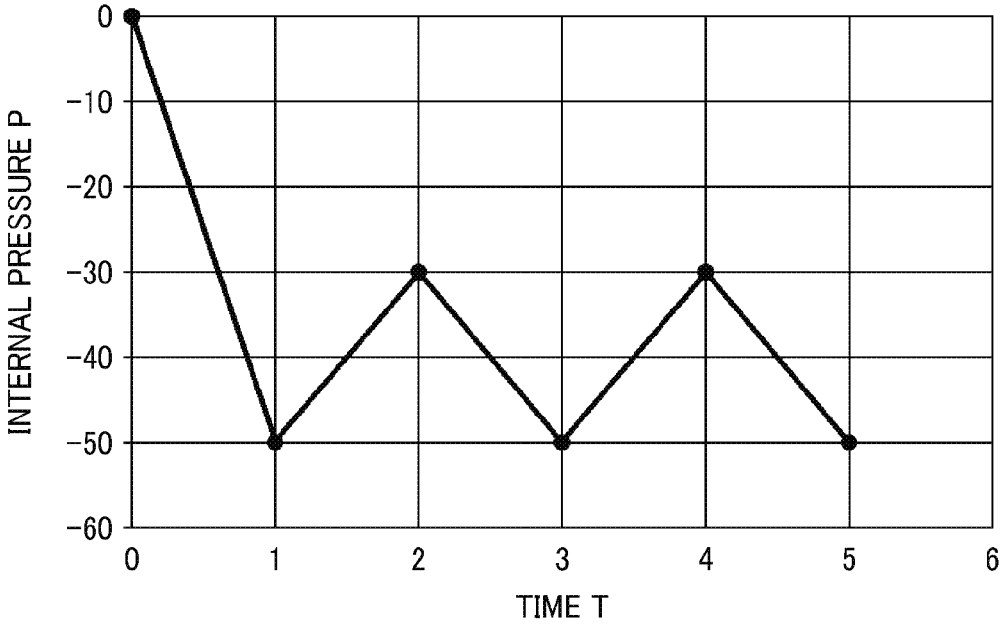
FIGS. 9A and 9B are a graph and a timing chart, respectively, illustrating a pressure control of the second container during an ink stirring process.
Figure 9B:
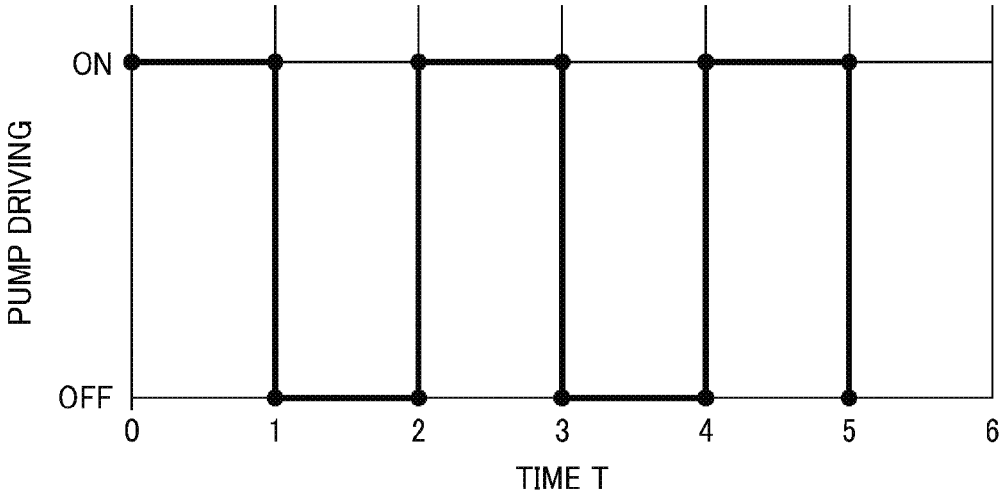

FIGS. 9A and 9B are a graph and a timing chart illustrating pressure control of the second container 102 during the ink stirring process in the present embodiment, respectively. FIG. 9A is the graph illustrating a relationship between an elapsed time T and an internal pressure P of the second container 102. FIG. 9B is the timing chart illustrating a relationship between an elapsed time T and driving of the vacuum pump 105.

The liquid dischargers 300A and 300B as described in FIG. 3 and FIGS. 6 to 8 perform a pressure control as illustrated in FIGS. 9A and 9B to stir ink. Specifically, the liquid dischargers 300A and 300B control an internal pressure in the second container 102 within a predetermined range between −30 and −50 as illustrated in FIG. 9A during reciprocally moving the ink. The liquid discharger 300A and 300B turn on and turn off the vacuum pump 105 for every predetermined time 1 as illustrated in FIG. 9B to control the internal pressure P in the second container 102 within the predetermined range. The unit of the elapsed time T and the internal pressure P in FIGS. 9A and 9B are arbitrary.

The liquid discharger 300A and 300B repeat decompression and pressurization of the second container 102 by repeating turning on and turning off of the vacuum pump 105 during moving ink between the cartridge 101 and the second container 102. Thus, the pressure value of the internal pressure P inside the second container 102 changes within the predetermined range. Therefore, according to the present embodiment, the internal pressure P in the second container 102 can be maintained within the predetermined range. Thus, the liquid discharger 300A and 300B of the present embodiment can maintain and stabilize a high supply speed to increase the stirring efficiency.

Figure 10:
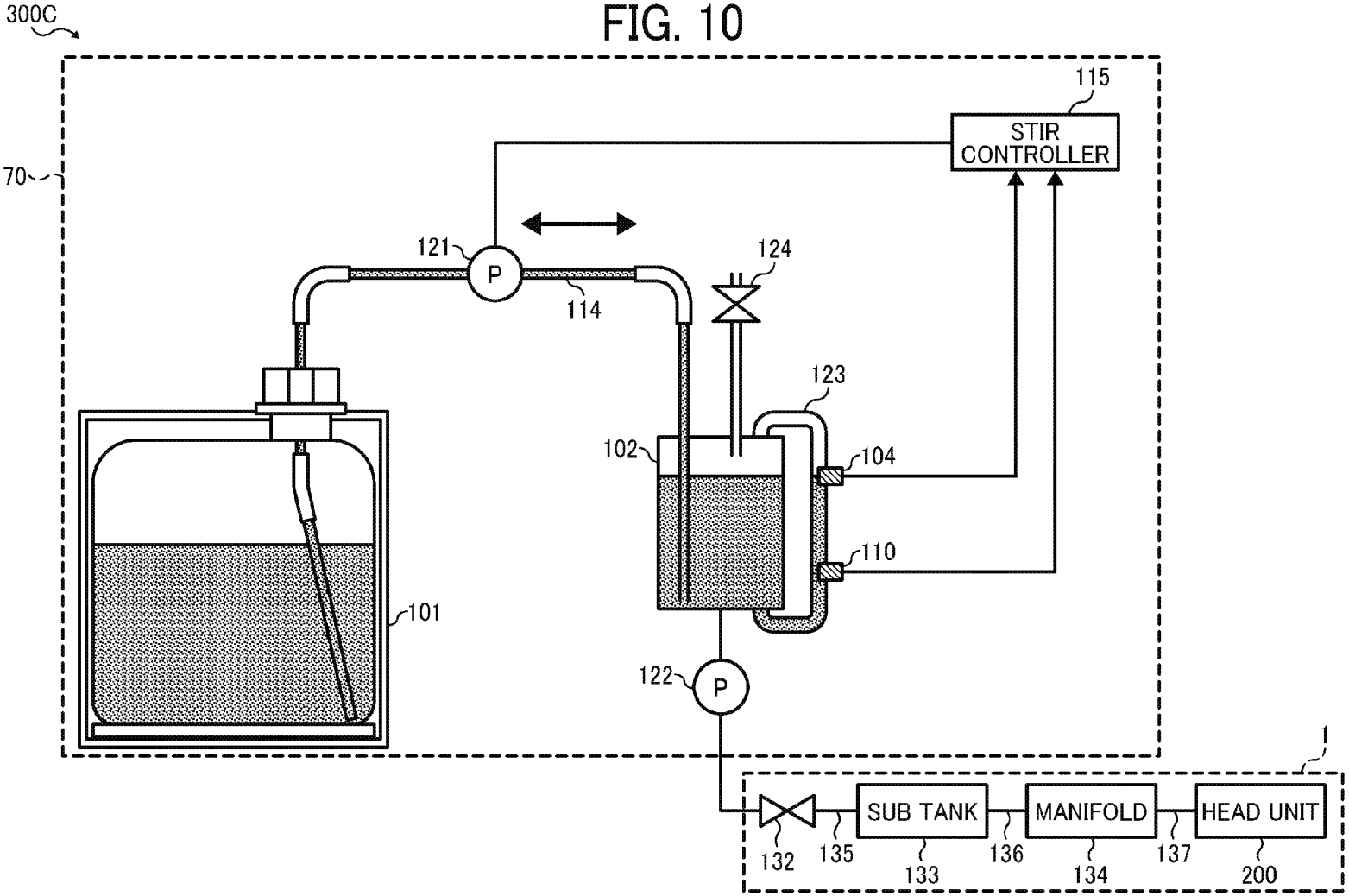
FIG. 10 schematically illustrates the liquid supplier device according to a fifth embodiment.

FIG. 10 schematically illustrates the liquid discharger 300C according to a fifth embodiment. As illustrated in FIG. 10, the liquid discharger 300C includes a cartridge 101, a second container 102, a reversible pump 121, a supply channel 114, an air release valve 124, a stir controller 115, and a second pump 122. A capacity of the second container 102 is smaller than a capacity of the cartridge 101. The supply channel 114 communicates the cartridge 101 with the second container 102.

The air release valve 124 is connected to the second container 102. The reversible pump 121 is disposed at the supply channel 114. A liquid detection channel 123 is provided outside the second container 102. The liquid detection channel 123 is connected to each of an upper part and a lower part of the second container 102. Further, a water repellency of the liquid detection channel is higher than a water repellency of an inner wall of the second container 102.

The liquid detection channel 123 includes a detector 104 and a second detector 110. The detector 104 and the second detector 110 detect a liquid amount in the second container 102. The second detector 110 is arranged at lower position than the detector 104 and higher position than the bottom of the second container 102 as illustrated in FIG. 10. Thus, the second detector 110 detects a liquid amount that is smaller than the liquid amount to be detected by the detector 104 and is larger than the empty amount.

The detector 104 and the second detector 110 are transmission sensors that can detect liquid level without contacting the ink inside the second container 102. The detector 104 and the second detector 110 are disposed at the liquid detection channel 123 to detect the liquid inside the liquid detection channel 123. The reversible pump 121 moves the ink between the cartridge 101 and the second container 102. The second pump 122 supplies the ink, which is stirred and has uniform density, from the second container 102 to the head unit 200.

An interior of the liquid detection channel 123 connected to the second container 102 is filled with the ink, and the liquid level in the liquid detection channel 123 is maintained at the same liquid level in the second container 102. The air release valve 124 connected to the second container 102 maintains the inner pressure in the second container 102 to be equal to outside air pressure. Further, the air release valve 124 discharges air entered into the second container when the cartridge 101 is detached from the liquid discharger 300C. The detector 104 is provided at upper part of the liquid detection channel 123. The detector 104 detects whether the ink is filled in the second container 102 up to the height of the detector 104. The second detector 110 is provided at lower part of the liquid detection channel 123. The second detector 110 is used when the ink in the second container 102 is supplied back to the cartridge 101.

The reversible pump is provided at the supply channel 114. The stir controller 115 is connected to the reversible pump 121. The stir controller 115 controls the reversible pump 121 to reciprocally move the ink between the cartridge 101 and the second container 102 via the supply channel 114. The reversible pump 121 can change a flow rate and a flow direction of ink flown through the supply channel 114 based on the control signal from the stir controller 115.

The stir controller 115 controls the flow direction of the reversible pump 121 in the direction from the cartridge 101 to the second container 102. Then, the stir controller drives the reversible pump 121 to transfer the ink from the cartridge 101 to the second container 102. Next, the stir controller 115 stops the reversible pump 121 to stop the ink supply from the cartridge 101 to the second container 102 when the detector 104 detects the ink in the liquid detection channel 123 that corresponds to an upper limit of liquid amount in the second container 102.

Then, the stir controller 115 changes the flow direction of the reversible pump 121 in the direction from the second container 102 to the cartridge 101. The stir controller 115 drives the reversible pump 121 to transfer the ink from the second container 102 to the cartridge 101. Next, the stir controller 115 stops the reversible pump 121 to stop the ink supply from the second container 102 to the cartridge 101 when the second detector 110 detects the ink in the liquid detection channel 123 that corresponds to a lower limit of liquid amount in the second container 102. Up to here, the ink moves reciprocally once between the cartridge 101 and the second container 102.

Figure 11:
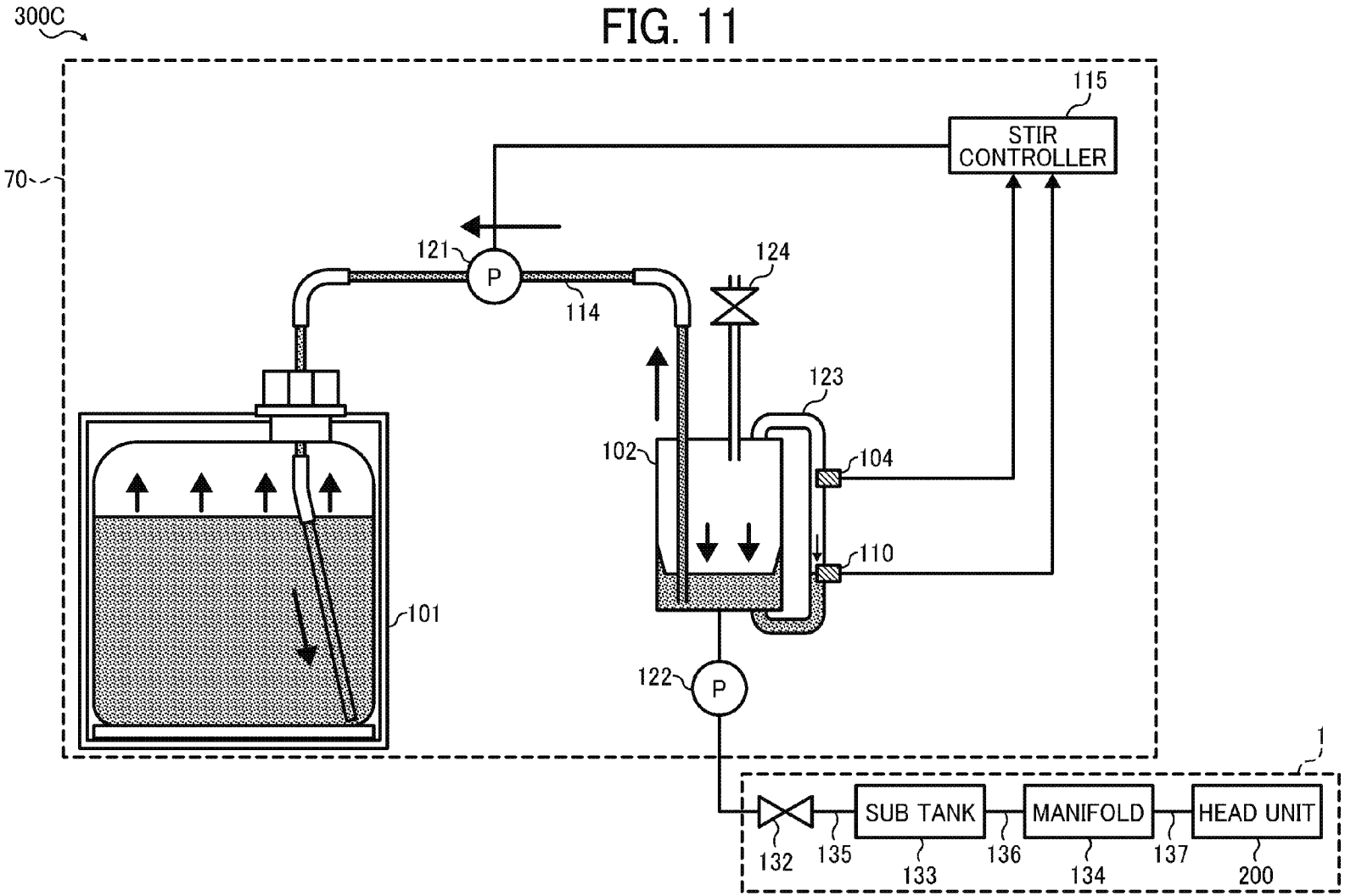
FIG. 11 is a schematic view illustrating a stirring operation of transferring the ink back to the cartridge from the second container.

FIG. 11 is a schematic view illustrating a stirring operation of transferring the ink back to the cartridge 101 from the second container 102. The stir controller 115 reverses the flow direction of the reversible pump 121 from the second container 102 to the cartridge 101 as indicated by arrow in FIG. 11 during backward route of the stirring operation. The liquid level in the second container 102 decreases with the operation of the reversible pump 121. At the same time, the liquid level in the liquid detection channel 123 also decreases.

The liquid discharger 300C uses a non-contact sensor to detect the liquid level in the second container 102 in order to prevent degradation of the ink or outside air entering into the second container 102. However, the liquid discharger 300C may detect the liquid level erroneously if the ink has low surface tension (wettability) so that the ink sticks and remains on the inner wall of the second container 102. Even when the contact type sensor is used as a detector, error detection may occur due to ink remaining on the detection part such as the liquid detection channel 123. During the normal printing operation, the speed of decrease of liquid level in the second container 102 is slow. Thus, the problem does not occur.

However, during the stirring operation, the speed of change of liquid level in the second container 102 is high. Thus, the sensor used in the detector 104 preferably has a high responsiveness to detect the liquid level in the second container 102. If the ink remains on the inner wall of the second container 102, the sensor remains "ON" even when the liquid level is lower than the position of the second detector 110 during the stirring operation of transferring the ink back to the cartridge 101 from the second container 102. Thus, the reversible pump 121 keeps running and may supply air to the cartridge 101.

However, because the liquid detection channel 123 of the present embodiment has higher water repellency than the inner wall of the second container 102, ink does not remained on the wall face of the liquid detection channel 123. Thus, the present embodiment can improve a response of liquid detection from the detector 104 and the second detector 110. Further, the present embodiment includes an optical transmission sensor as a detector on the liquid detection channel 123 and detects liquid level with the optical transmission sensor. The present embodiment can thereby detect the liquid level accurately without contacting the liquid.

The liquid detection channel 123 is preferably made of material having higher water repellency with ink than the inner wall of the second container 102, such as a fluororesin tube. Therefore, it is possible to make a falling speed of the liquid level in the second container 102 and a falling speed of the liquid level in the liquid detection channel 123 substantially same during the stirring operation of transferring the ink back to the cartridge 101 from the second container 102. Thus, the present embodiment can accurately detect the liquid level in the second container 102.

Further, the liquid discharger 300C illustrated in FIGS. 3 to 8 may have the same configuration with the configuration illustrated in FIGS. 10 and 11 that have the liquid detection channel 123 and optical transmission sensor to detect the liquid level in the liquid detection channel 123. Thus, the present embodiment can improve the responsiveness of detecting the liquid level, and thereby accurately detect the liquid level in the second container 102 without contacting the liquid surface.

Figure 12:
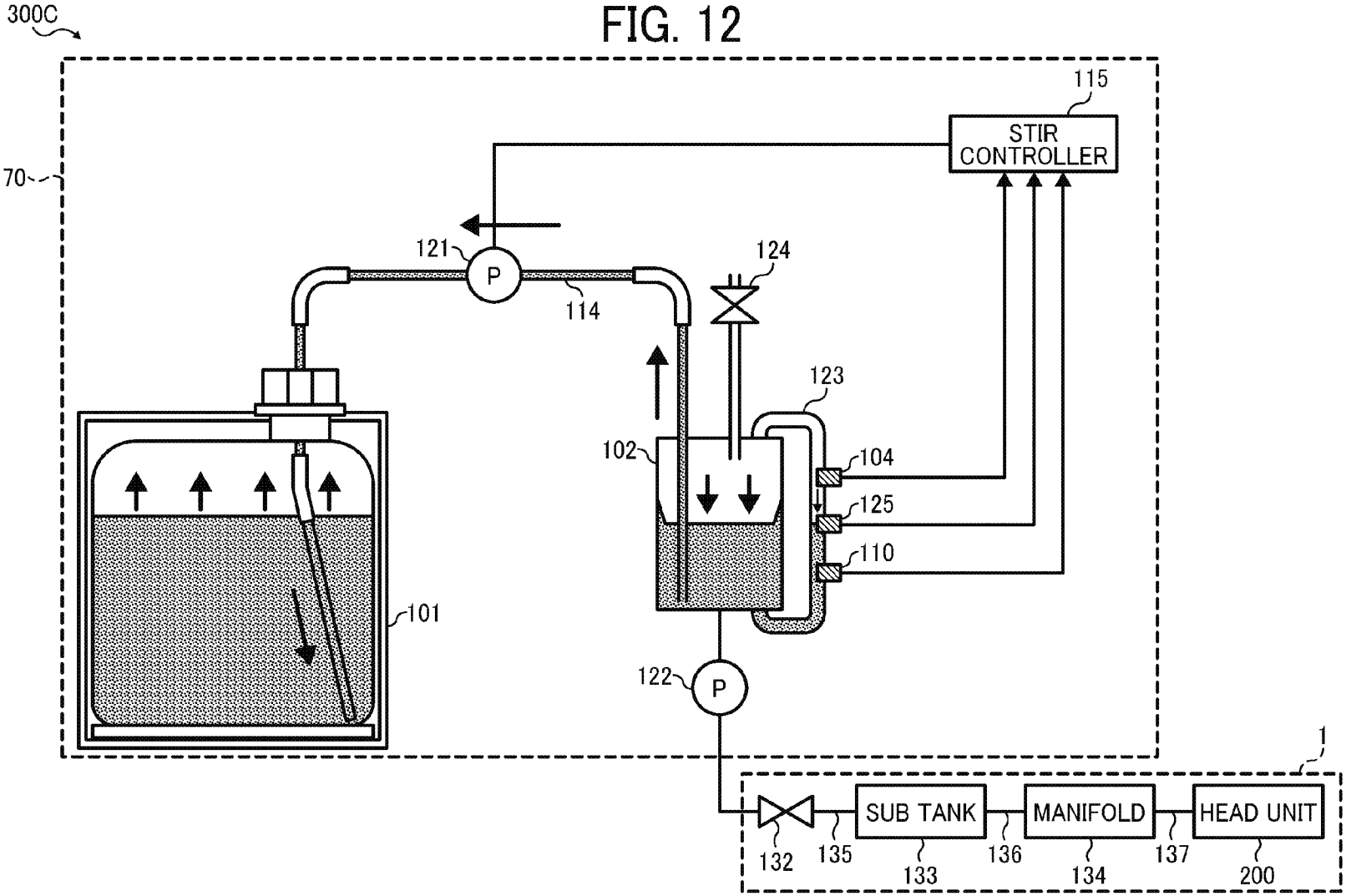
FIG. 12 schematically illustrates the liquid supplier device according to a sixth embodiment of the present disclosure.

FIG. 12 is a schematic view of the liquid discharger 300C according to a sixth embodiment. In FIG. 12, parts or components similar to those illustrated in FIGS. 10 and 11 are given the same reference numerals and redundant description thereof omitted.

As illustrated in FIG. 12, the liquid detection channel 123 includes a detector 104, a second detector 110, and a third detector 125. The detector 104 detects a liquid level in the liquid detection channel 123 to detect an upper-limit liquid amount in the second container 102. The second detector 110 is arranged at lower position than the detector 104 and at higher position than the bottom of the second container 102 as illustrated in FIG. 12. The second detector 110 detects a liquid amount that is smaller than the liquid amount to be detected by the detector 104 and is larger than the empty amount. The third detector 125 is arranged between the detector 104 and the second detector 110 to detect the liquid amount between the liquid amount detected by the detector 104 and the liquid amount detected by the second detector 110 in the second container 102.

FIG. 12 is a schematic view illustrating a stirring operation of transferring the ink back to the cartridge 101 from the second container 102. Because the present embodiment has three level of detecting the liquid level in the liquid detection channel 123 using three detectors, the present embodiment can reduce the amount of ink moved in one time when the ink remaining amount in the cartridge 101 is small. The stir controller 115 may change the liquid amount to be moved between the cartridge 101 and the second container 102 according to the liquid amount remained in the cartridge 101.

The stir controller 115 starts the stirring operation from an upper limit of the ink level detected by the detector 104. Then, the stir controller 115 moves the ink back to the cartridge 101 from the second container 102. The stir controller 115 ends the stirring operation of the backward movement of the ink from the second container 102 to the cartridge 101 when the third detector 125 detects the ink in the liquid detection channel 123.

The stir controller 115 moves the ink between the cartridge 101 and the second container 102 at once for a difference liquid amount corresponds to a difference of two liquid amount (liquid level) detected by the detector 104 and the third detector 125 during the ink stirring operation. Therefore, the stir controller 115 can stir the ink in the cartridge 101 without sucking air into the second container 102 and the cartridge 101 even the liquid amount in the cartridge 101 is small. Further, the stir controller 115 can prevent detecting an ink end and stopping stirring operation that is occurred when the stirring operation is performed with small ink remaining amount in the cartridge 101.

Further, the liquid dischargers 300A and 300B illustrated in FIGS. 3 to 8 may have the same configuration with the configuration illustrated in FIG. 12 that has the liquid detection channel 123 and the optical transmission sensors to detect three liquid levels in the liquid detection channel 123.

The present embodiment uses the irreversible vacuum pump 105 having a higher supply capacity than a reversible pump. Thus, the liquid discharger 300 of the present embodiment can pressurize and decompress the second container 102 with greater pressure than the liquid discharger using reversible pump. Therefore, the liquid discharger 300 reciprocally moves and stirs ink in the supply channel 114 with higher flow rate than before. Thus, the present embodiment can increase the stirring ability without increasing the time the ink was stirred.

As a liquid discharger, such as a printer, a facsimile machine, a plotter, or a multifunction machine including at least two of these functions, an inkjet recording apparatus that uses a recording head (liquid discharge head) for discharging ink droplets (liquid droplets) is known. The liquid discharger 300 discharges ink droplet from the nozzle 212 of the head 210 and causing droplets to land on the medium to form image on a recording medium. The term "image formation" includes aspects of providing not only meaningful images, such as characters and figures, but also meaningless images, such as patterns, to a recording medium. Further, the term "image formation" includes not only two-dimensional image but includes three-dimensional image (solid image).

The head 210 is a functional component that discharge droplet from the nozzle 212. As an actuator of the head 210, other than a piezoelectric actuator, a thermal actuator using an electricity-heat conversion element can be used. The piezoelectric actuator deforms a vibration plate to change a volume of an individual chamber to increase the pressure inside the individual chamber to discharge droplet. The thermal actuator drives an electricity-heat conversion element to generate air bubble that increases the pressure inside an individual chamber to discharge droplet.

Moreover, "recording medium" includes not only paper but also any materials onto which droplet can adhere, such as, an overhead projector (OHP) sheet, fabric, textile, leather, metal, plastic, glass, wood, ceramics, etc., and is used as a generic term for a recording medium, recording paper, a recording sheet, etc.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

A liquid discharge device is an integrated unit including the head 210 and a functional part(s) or unit(s), and is an assembly of parts relating to liquid discharge. For example, the liquid discharge device includes at least one of the head 210, the second container 102, and the pressure unit 202. In the above-described embodiments of the present disclosure, the liquid discharge apparatus includes a liquid discharge device that drives the head 210 to discharge liquid. The liquid discharge apparatus may be, for example, an apparatus capable of discharging liquid onto a material, to which liquid can adhere, or an apparatus to discharge liquid toward gas or into another liquid. The liquid discharge apparatus includes a three-dimensional fabricating apparatus, a liquid coating apparatus, and a toner manufacturing apparatus, etc.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharger comprising:

a head including nozzles, to discharge liquid from the nozzles;

a detachable first container attached to the liquid discharger to accommodate the liquid;

a second container connected to the head to accommodate the liquid to be supplied to the head;

a supply channel to connect the first container and the second container;

an irreversible pump connected to the second container; and a controller to control the irreversible pump to pressurize and decompress the second container to reciprocally move the liquid between the first container and the second container via the supply channel.

2. The liquid discharger according to claim 1, further comprising:

a first three-way valve and a second three-way valve that are independently operated by the controller, to control a flow direction of the liquid moved between the first container and the second container by the irreversible pump; and a pressure detector to detect a pressure inside the second container.

3. The liquid discharger according to claim 1, further comprising a memory in which the controller stores time and volume of the liquid previously reciprocally moved in the supply channel, wherein the controller controls the irreversible pump to reciprocally move the liquid after a predetermined time has passed since previously reciprocally moving the liquid.

4. The liquid discharger according to claim 1, further comprising a memory in which the controller stores a time of liquid previously reciprocally moved in the supply channel and a liquid amount stored in the first container, wherein the controller controls the irreversible pump to reciprocally move the liquid after a predetermined time has passed since previously reciprocally moving the liquid.

5. The liquid discharger according to claim 1, wherein the controller controls a frequency of reciprocally moving the liquid based on a type of the liquid and a time of previously reciprocally moving the liquid.

6. The liquid discharger according to claim 1, further comprising:

a first detector to detect a liquid amount in the second container; and a second detector to detect a liquid amount that is smaller than the liquid amount detected by the detector and is larger than an empty amount, wherein the controller controls a liquid amount supplied to the supply channel based on detection signals output from the first detector and the second detector.

7. The liquid discharger according to claim 1, further comprising another first container attached to the liquid discharger to accommodate the liquid.

8. The liquid discharger according to claim 7, wherein the liquid is moved between the first container and the another first container via the second container.

9. The liquid discharger according to claim 1, wherein the controller drives the irreversible pump to maintain pressure inside the second container within a predetermined range while reciprocally moving the liquid in the supply channel.

10. The liquid discharger according to claim 1, further comprising:

a liquid detection channel provided outside the second container and connected to each of an upper part and a lower part of the second container; and a transmission detector disposed at the liquid detection channel to detect a liquid amount in the second container.

11. The liquid discharger according to claim 10, wherein a water repellency of the liquid detection channel is higher than a water repellency of an inner wall of the second container.

12. The liquid discharger according to claim 1, wherein the controller changes a liquid amount to be moved between the first container and the second container based on a liquid amount remaining in the first container.

13. The liquid discharger according to claim 1, wherein a capacity of the second container is smaller than a capacity of the first container.

14. A liquid discharger, comprising:

a head including nozzles to discharge liquid from the nozzles;

a container connected to the head to accommodate the liquid to be supplied to the head and to be discharged from the nozzles;

an irreversible pump including an inflow port and an outflow port;

a first three-way valve including (a1) a first pump port connected to the inflow port of the irreversible pump and (a2) a first container port connected fluidly to the container;

a second three-way valve including (b1) a second pump port connected to the outflow port of the irreversible pump and (b2) a second container port connected to the container; and a controller to control the irreversible pump, the first three-way valve, and the second three-way valve to alternately pressurize and decompress the container, wherein the first container port of the first three-way valve is directly connected the second container port of the second three-way valve to form a ring-shaped channel so that the irreversible pump, the first three-way valve, and the second three-way valve form a ring-shaped pressure unit connected to the container with a single channel to pressurize and decompress the container; and the controller is further configured to (I) pressurize the container, opening the first pump port and closing the first container port of the first three-way valve, and opening the second pump port and the second container port to fluidly connect the irreversible pump via the second three-way valve to the container, and (II) decompress the same container that is pressurized in (I), opening the first pump port and the first container port to fluidly connect the irreversible pump via the first three-way valve to the container, and opening the second pump port and closing the second container port of the second three-way valve.

15. The liquid discharger according to claim 14, wherein the first three-way valve includes an intake port to intake air to pressurize the container; and the second three-way valve includes an exhaust port to exhaust air from the container to decompress the container.

16. A liquid discharger, comprising:

a head including nozzles to discharge liquid from the nozzles;

a container connected to the head to accommodate the liquid to be supplied to the head and to be discharged from the nozzles;

a fluid channel including a first channel, a second channel, and a third channel, one end the first channel being connected to the container and another end of the first channel being connected to the second channel and the third channel;

an irreversible pump including an inflow port and an outflow port;

a first three-way valve including (a1) a first pump port connected to the inflow port of the irreversible pump and (a2) a first container port connected fluidly to the container the second channel;

a second three-way valve including (b1) a second pump port connected to the outflow port of the irreversible pump and (b2) a second container port connected to the third channel; and a controller to control the irreversible pump, the first three-way valve, and the second three-way valve to alternately pressurize and decompress the container, the controller configured to (I) pressurize the container, opening the first pump port and closing the first container port of the first three-way valve, and opening the second pump port and the second container port to fluidly connect the irreversible pump via the second three-way valve, the third channel, and the first channel to the container, and (II) decompress the same container that is pressurized in (I), opening the first pump port and the first container port to fluidly connect the irreversible pump via the first three-way valve, the second channel, and the first channel to the container, and opening the second pump port and closing the second container port of the second three-way valve.

17. The liquid discharger of claim 16, wherein the first three-way valve includes an intake port to intake air to pressurize the container; and the second three-way valve includes an exhaust port to exhaust air from the container to decompress the container.

* * * * *